US005336151A

United States Patent [19]

Van Ballegooie

[11] Patent Number: 5,336,151

[45] Date of Patent: Aug. 9, 1994

[54] BODY EXERCISE DEVICE

[75] Inventor: Paul Van Ballegooie, Gilbert, Ariz.

[73] Assignee: Energize International, Inc., Phoenix, Ariz.

[21] Appl. No.: 129,730

[22] Filed: Sep. 14, 1993

[51] Int. Cl.[5] ..... A63B 21/02

[52] U.S. Cl. ..... 482/124; 482/121

[58] Field of Search ..... 482/124, 125, 148, 121, 482/74, 122, 421, 51, 52, 79, 105, 129, 143, 907

[56] References Cited

U.S. PATENT DOCUMENTS

| | | | |
|---|---|---|---|
| 650,565 | 5/1900 | Raabe . | |
| 712,827 | 11/1902 | Maxwell et al. . | |
| 843,478 | 2/1907 | Muller . | |
| 866,495 | 9/1907 | Marks | 482/124 |
| 1,194,884 | 8/1916 | Sandow . | |
| 1,618,273 | 2/1927 | Davidson . | |
| 2,097,376 | 10/1937 | Marshman . | |
| 4,606,542 | 8/1986 | Segal . | |
| 4,815,731 | 3/1989 | Suarez et al. | 482/124 |
| 4,889,336 | 12/1989 | Schneiderman . | |
| 4,910,802 | 3/1990 | Malloy . | |
| 5,062,642 | 11/1991 | Berry et al. | 482/124 |
| 5,137,272 | 8/1992 | Wilkinson | 482/124 |
| 5,186,701 | 2/1993 | Wilkinson | 482/125 |

FOREIGN PATENT DOCUMENTS

| | | | |
|---|---|---|---|
| 358494 | 2/1906 | France | 482/124 |
| 434067 | 8/1935 | United Kingdom | 482/124 |
| 0451516 | 8/1936 | United Kingdom | 482/124 |

*Primary Examiner*—Richard J. Apley
*Assistant Examiner*—Jerome Donnelly
*Attorney, Agent, or Firm*—LaValle D. Ptak

[57] ABSTRACT

A body exercise device includes a waist belt, which is releasably fastened on the waist of the user. A plurality of snap rings are pivotally attached to the belt at spaced intervals throughout its length to provide different attachment locations for elongated elastic members. The elastic members have snap hooks connected at opposite ends, with one end of each elastic member connected to a selected one of the snap rings on the belt. Foot pieces are provided for each foot of the user; and each of the foot pieces has a snap ring on it for attachment to a snap hook on the opposite end of an elastic member. Hand pieces also are provided for each hand, and include a hand-encircling portion and a wrist protector portion with a swivel snap ring on them, to which a snap hook on the opposite end of a corresponding elastic member is attached. The foot members also have swivel snap rings located on an ankle encircling portion on the inside of each ankle for connection to an additional elastic member by means of snap hooks located on each end. Various exercises can be performed by the exercise device; and different muscles may be exercised by connecting the elastic members to different ones of the snap rings on the waist encircling member, in accordance with the exercise to be performed.

15 Claims, 2 Drawing Sheets

FIG. 1
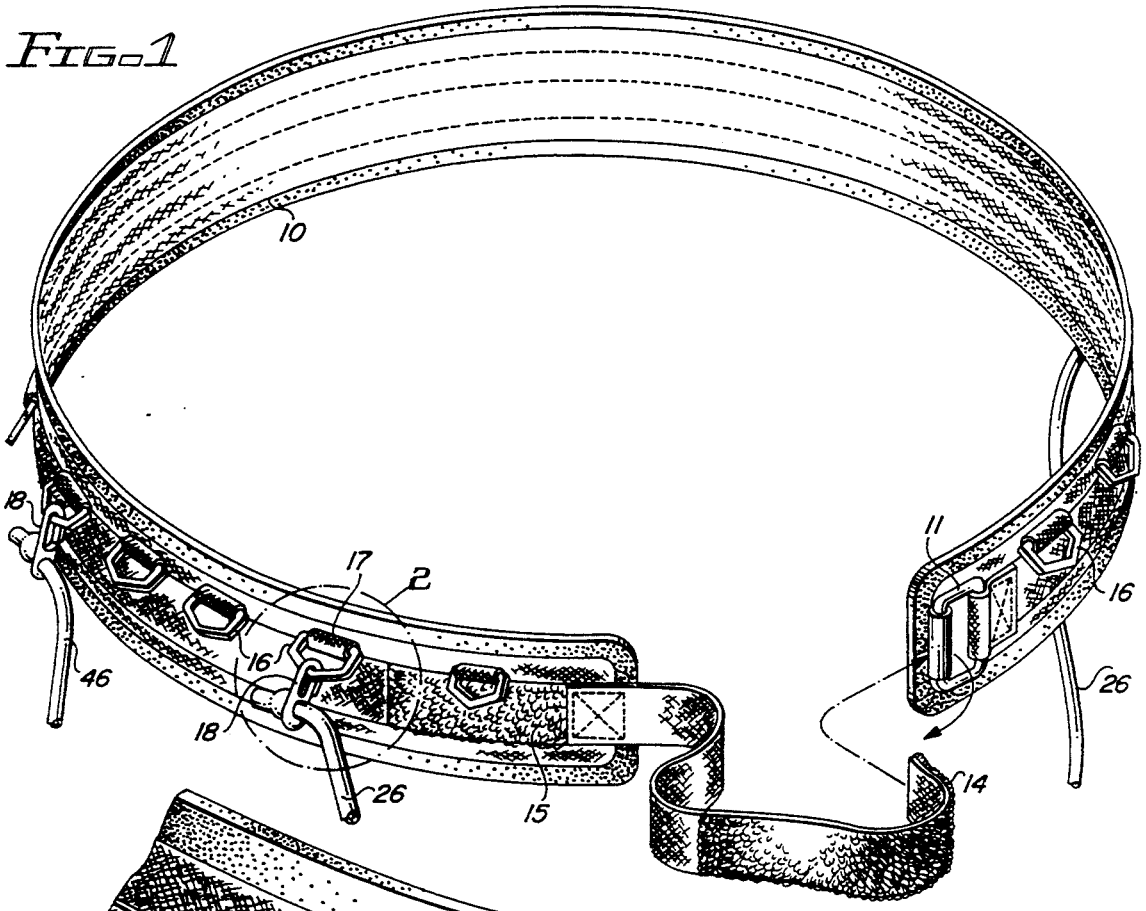
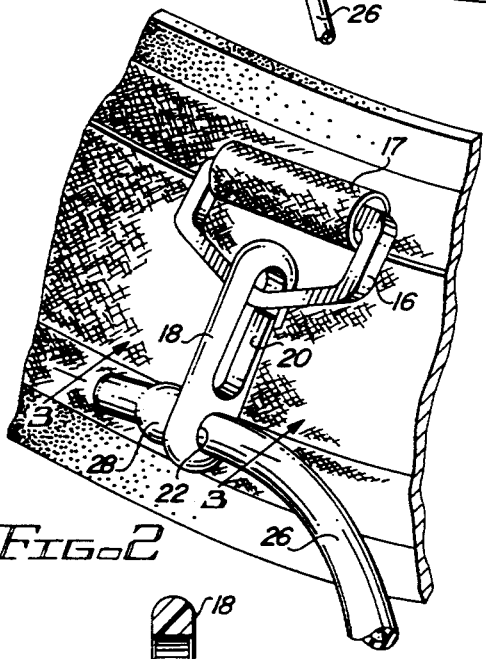
FIG. 2
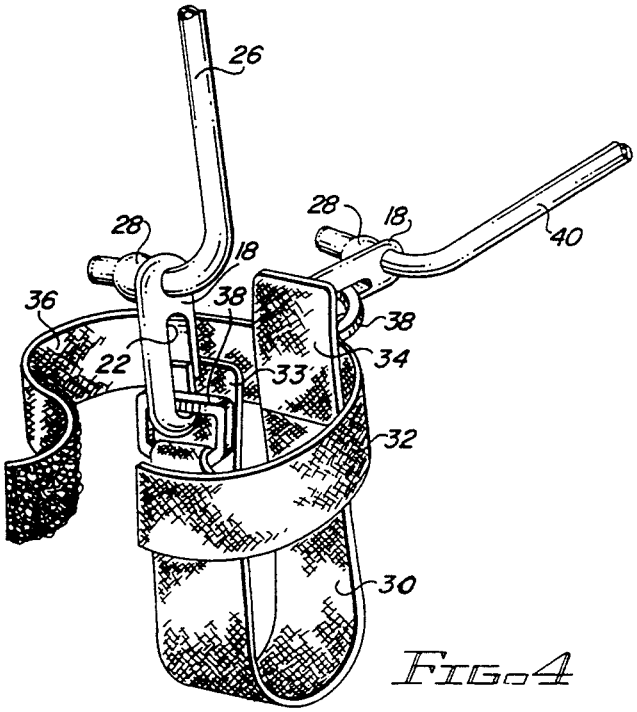
FIG. 4
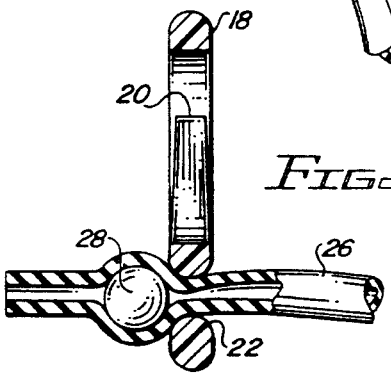
FIG. 3

BODY EXERCISE DEVICE

BACKGROUND

Modern people increasingly find themselves working at jobs which are sedentary or which require less and less physical exertion. As a consequence, in order to maintain physical fitness, many people turn to fitness centers, aerobic exercises and other forms of recreational activity to develop or maintain good physical condition of their bodies. Fitness centers typically include a variety of equipment on which the members perform various exercises for developing the muscle tone and building of muscles in different parts of their bodies. There are rowing machines, stair climbing machines, treadmills, weight lifting machines in a wide variety of configurations. Machines of this type, however, are relatively bulky, and for that reason, generally are found only in commercial fitness centers. Machines are sold for home use; but each machine requires substantial storage space in the home, and frequently any given machine is capable only of exercising some, but not all, of the muscles in a person's body.

Over the years, exercise devices which are relatively small, lightweight and portable have been developed, which employ elastic cords attached to some type of a harness worn on the torso of the body, and extending to hand grips and foot straps to provide tension against the movement of the arms and legs of the wearer for use in various exercises to maintain physical fitness.

Three body harness exercising devices are disclosed in the U.S. patents to Raabe U.S. Pat. No. 650,656; Maxwell U.S. Pat. No. 712,827; and Marshman U.S. Pat. No. 2,097,376. All of these patents disclose body harnesses to which elastic bands are attached for use in leg and arm exercises.

The harness of the Maxwell patent is worn about the chest of the user, and includes pulleys mounted on a slide-like member to permit tension to be applied between the arms and feet of the user by stretching elastic bands guided over these pulleys. A helmet also is provided, and it is attached by means of elastic cords to the harness for use in strengthening the leg muscles.

The Mueller U.S. Pat. No. 843,478 discloses a harness device which is similar to that of Maxwell, except that the harness is attached at the waist instead of at the chest of the user. Elongated elastic bands extend from foot stirrups to hand grips, and pass through loops on the waist encircling belt. The exercise then takes place by means of tension between the arm and leg on the same side of the body as in the Maxwell device.

The patents to Raabe and Marshman both are directed to an upper torso harness with a waist encircling portion and a portion extending over the chest region. In Raabe, elastic cords are connected between hand grips and two points on the back of the harness for providing arm exercises. Similar attachments are provided between two points at the waist, for the attachment of stretchable elastic cords between the feet and the back of the harness. The attachment locations are fixed; so that all of the stretching of the cords takes place from the back side of the harness.

The device of Marshman is similar to that of Raabe, except that the connections to the feet are provided by elastic cords on both the front and back sides of the harness. For the hand grips, the connections are at the front of the chest of the harness, rather than at the back, as disclosed in the Raabe patent. The devices of Marshman and Raabe, however, otherwise operate in much the same way.

Another body exerciser harness device is disclosed in the patent to Davidson U.S. Pat. No. 1,618,273. The device of Davidson is similar to that of Marshman, inasmuch as it employs a waist band and a chest band. In Davidson, the leg stirrups and the hand grips are connected through snap rings to rings on the waist bands and chest bands, respectively, for performing various exercises. In the use of the device of Davidson, as well as the devices of the other patents discussed above, movements of the user are resisted in certain directions by tensing or stretching of the elastic bands extending from the waist or chest region of the harness.

It is desirable to provide a simple elastic tensioning exercise device, which has increased versatility over the devices of the prior art, and which is simple to use in performing a wide variety of exercises.

SUMMARY OF THE INVENTION

Accordingly, it is an object of this invention to provide an improved body exercise device.

It is an additional object of this invention to provide an improved body exercise device using elastic tensioning bands.

It is an additional object of this invention to provide an improved body exercise device capable of providing independent exercises of each of the arms and legs of the user in several different configurations.

In accordance with a preferred embodiment of the invention, a body exercise device includes a waist encircling member with connector devices attached to it at spaced intervals along its length. A foot piece is releasably attached to the foot of a user; and a first elastic member is connected at one end to the foot piece and at the other end to one of the connector devices on the waist encircling member. A hand piece is connected by means of a second elastic member to a selected one of the connector devices on the waist encircling member. By changing the points of connection of the elastic members with different ones of the connector devices on the waist encircling member, exercises for developing different muscles may be performed by the user.

BRIEF DESCRIPTION OF THE DRAWINGS

FIG. 1 is a front perspective view of a portion of a preferred embodiment of the invention;

FIG. 2 is an enlarged detail of the portion circled as "2" in FIG. 1;

FIG. 3 is a cross-sectional view taken along the line 3—3 of FIG. 2;

FIG. 4 is a perspective view of another portion of the preferred embodiment of the invention;

DETAILED DESCRIPTION

Figure 5:
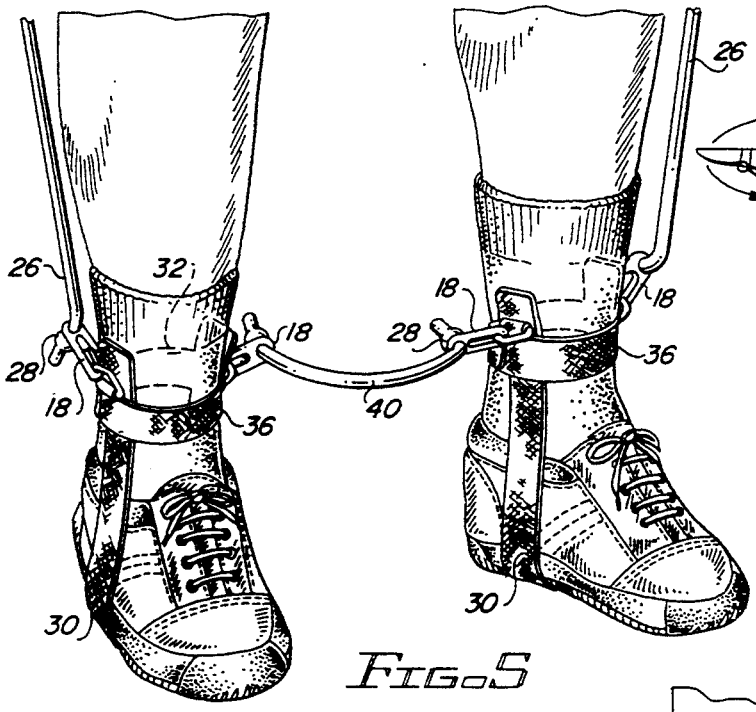
FIG. 5 illustrates the manner of use of the portion of the device shown in FIG. 4.

Reference now should be made to the drawings, in which the same reference numbers are used throughout the different figures to designate the same components. The body exercise device comprises a waist encircling band or wide belt 10, typically made of relatively strong material, such as padded nylon or the like. To permit use of the waist encircling member 10 on persons having different waist measurements, a releaseable fastener includes a belt loop 11. An extension 14, having one-half of a hook-and-loop fastener material such as Velcro® on it for mating with the other half of the hook-and-loop fastener material attached to the face of the member 10, is looped through the loop 11 in the direction of the arrows shown. The extension 14 then is pressed into contact with the portion 15 to secure the belt member 10 on the waist of the user.

As shown most clearly in FIGS. 1 and 2, a plurality of hook rings 16 are secured at spaced intervals about the entire length or periphery of the member 10 through fabric loops 17, which are sewn to the member 10. The rings are firmly but loosely held by the fabric loops 17; so that limited pivotal movement of the rings 16 may take place. Releasable connections of elongated elastic tubes 26 and 46 to various ones of the rings on the belt member 10 are effected by means of snap hooks 18, which have a snap hook portion 20 on one end, and a circular hole 22 through them at the opposite end, as shown most clearly in FIG. 2. As illustrated in FIGS. 2 and 3, for an elastic tube 26, the tube 26 first is inserted 17 through the hole 22 in a snap hook 18. After this is done, a spherical ball, such as a small steel or plastic ball 28, which has a diameter larger than the hole 22, is inserted by means of a spreader tool (not shown) into the open end of the tube to a relative position as illustrated in FIGS. 2 and 3. The spreader tool then is removed, and the resiliency of the tube securely holds the ball 28 in place, as shown in FIG. 3, against stretching forces applied to the other end of the tube 26. This also is true of the tube 46.

A pair of foot stirrups or foot harnesses 30 are provided, and as illustrated in FIGS. 4 and 5, the portions 30 extend underneath the foot of the user. The upper ends 33 and 34 of this U-shaped stirrup 30 extend to points terminating on opposite sides of the ankle of the user, as illustrated in FIG. 5. At a point a short distance below the upper ends of the extensions 33 and 34, an ankle encircling band 32 is provided. The exterior surface of the band 32 is provided with one-half of a hook-and-loop fastener, such as Velcro®. The inner side of a free end portion 36, which is shown open in FIG. 4, is provided with the other half of the hook-and-loop fastener. Thus, when the device is open as shown in FIG. 4, a foot may be placed in it to the position shown in FIG. 5, and then the portion 36 pulled tightly around the ankle to engage the surface 32 of the remainder of the band to firmly position the device on the foot and ankle of the user.

Extending from opposite sides of the ankle encircling band 32/36 are a pair of pivoted connector rings 38, which are secured to the band 32/36 by means of fabric loops, such as the loop 17 attached to the belt member 10. Each of these rings 38 is capable of releasable connection with a snap hook 18 of the type illustrated in FIGS. 1 and 2, which in turn is attached to the opposite end of an elongated elastic or stretchable rubber tube 26 secured to the snap hook 18 by means of a ball 28, in the same manner as illustrated in FIG. 3. A pair of the elastic tubes 26 may be provided, one for each foot, as illustrated in FIG. 5. The connections between the rings 38 on the foot stirrup devices shown in FIG. 5 and the elastic tubes 26 are effected on opposite sides of the belt member 10, as illustrated in FIG. 1. The length of the elastic tubes 26 and the parameters of the material, such as the wall thickness and the material out of which it is made, such as Neoprene rubber, determine the amount of force or tension which is applied between the waist of the user and the foot stirrups 30/32/36.

Figure 6:
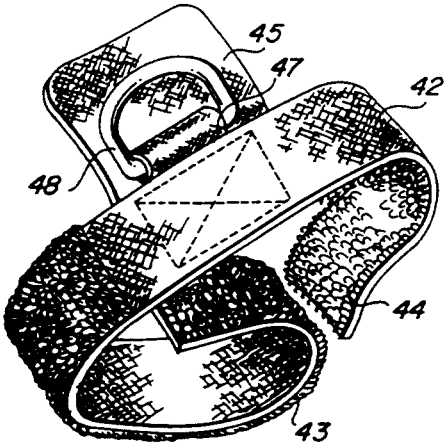
FIG. 6 is a perspective view of another portion of the preferred embodiment of the invention.
Figure 7:
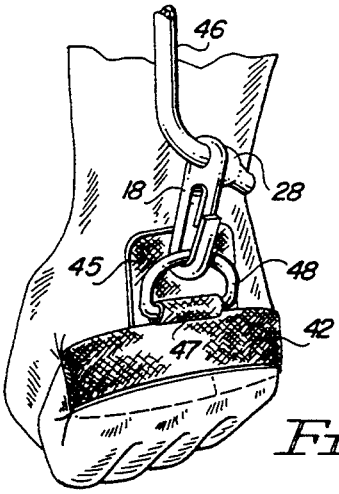
FIG. 7 shows the manner of use of the portion shown in FIG. 6.

Connections for the hands are made by means of elastic tubes 46, which are similar to the tubes 26 described above. The tubes 46 extend between snap hooks 18 in the same manner as the connections between the waist member 10 and the foot stirrups are made. For the hands, an elongated rectangular band 42 made of a suitable fabric, such as nylon, is provided. The band has one-half of a hook-and-loop fastener material 44 attached to the inside of one free end; and the outside of the other free end is provided with the other half of a hook-and-loop fastener material 43. This is illustrated most clearly in FIG. 6. Attached to the portion of the band 42 which extends over the top of the hand, is an elongated flap 45, which extends over the top of the hand or wrist of the user. The flap 45 is positioned under a pivotal connector ring 48, which is secured to the band 42 by means of a loop of material 47. As illustrated in FIG. 7, the ring 48 may be releaseably connected by means of a snap hook to one end of an elongated elastic tube 46, the other end of which is secured, as illustrated in FIG. 1, by means of a snap hook 18 to one of the loops 16 on the belt member 10.

As illustrated in FIG. 7, the band 42 extends over the top of the hand and over the palm, where it is secured in place by the hook-and-loop fasteners 43/44 to permit it to be gripped by closing the fist of the user. It is readily apparent that the use of the fastener material 43/44 permits adjustment of the hand grip 42 to accommodate hands of various sizes quickly and comfortably.

As illustrated in FIG. 5, an additional interconnection between the two foot stirrups worn by user also may be utilized for some exercises. To do this, the connections to the foot stirrups, by means of the tubes 26 to the waist member 10, are effected by connecting the snap hooks 18 on the ends of the tubes 26 to the outside loops 38. The inside loops 38 then are connected by means of snap hooks 18 on opposite ends of a relatively short piece of elastic tubing 40, of the same type as the tubing 26 and 46, as illustrated in FIG. 5. This causes a tension to be placed between the feet of a user when the feet are placed at distances greater than the relaxed length of the tube 40.

Figure 8A:
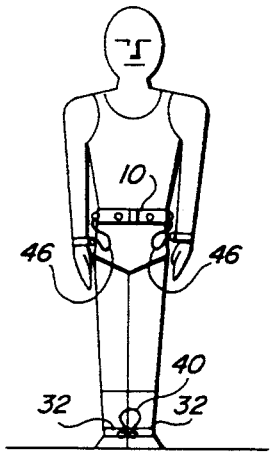
FIGS. 8A and 8B illustrate the use of the invention for an exercise.
Figure 8B:
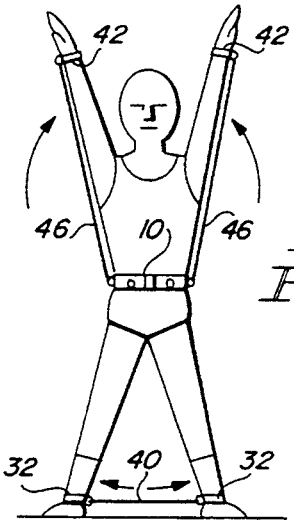

FIGS. 8A and 8B illustrate a popular "jumping-jack" exercise using the tube 40 to increase the tension between the feet of a user in the portion of the jumping-jack exercise where the feet extend apart, as illustrated in FIG. 8B. In a jumping-jack exercise, as is well known, the hands are moved from the position shown in FIG. 8A to the position shown in FIG. 8B. As the hands move from the position of FIG. 8A to the position of FIG. 8B, the elastic tubes 46 are stretched (once they are extended beyond their relaxed length) as illustrated in FIG. 8B. It also should be noted in FIGS. 8A and 8B, that the snap hooks 18 on the ends of the tubes 46 are connected to loops 16 on opposite sides of the waist belt 10.

Figure 9A:
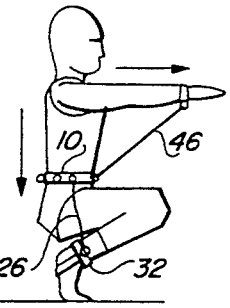
FIGS. 9A and 9B illustrate the use of the invention for another exercise.
Figure 9B:
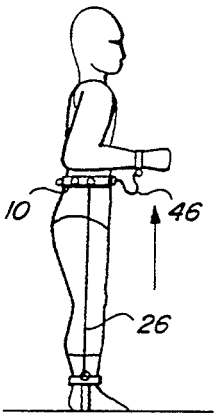

FIGS. 9A and 9B illustrate a different exercise, which may be employed to develop different muscles in both the legs and arms. In the configuration of the device of FIGS. 9A and 9B, the ends of the tubes 46 connected to the hand grips 42 are connected at the belt member 10 to loops 16 located on the front of the belt member. This is readily effected, for example, in changing from the position of FIGS. 8A and 8B simply by means of releasing the snap hook 18 from one of the rings 16 and placing it on a desired other ring 16 on the belt member 10. Also, as illustrated in FIGS. 9A and 9B, the elastic tubes 26 are connected to the belt member 10 on snap rings 16 located substantially on opposite sides of the user.

Figure 10:
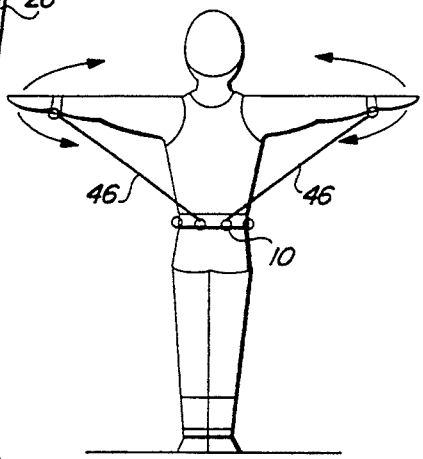
FIG. 10 illustrates another exercise useful to explain features of the invention.

FIG. 10 illustrates a different exercise for the arms, in which the releasable snap hooks 18 connected to the elastic tubes 46 for the arms are connected into rings 16 located on the back of the belt member 10. Other variations of the interconnections, both with the elastic tubes 46 and the elastic tubes 26 for the foot stirrups, may be effected, as desired, to apply the tension in different ways to the extremities of the person using the device for different exercises.

It is readily apparent that the device provides a great deal of flexibility for performing a wide variety of exercises. When the exercise time is finished, the various fasteners which are used to secure different parts of the device to the feet and hands of the user, as well as the waist, quickly and readily may be released. When not in use, the device of the invention is capable of being stored in a small space, such as a drawer; so that it is not obtrusive, as in the case of weight lifting machines and the like. This is of particular significance for use of this exercise device in the home. In addition, because of its light weight and small size, the device easily may be carried by a traveler, such as a business person, in a suitcase or brief case; so that it may be available wherever the user wants to use it.

While the elastic tubes 26 and 46 may be made of any desirable material, it has been found that surgical tubing made of Neoprene rubber with an external diameter of approximately ⅜" and an internal diameter of approximately ⅛", provides excellent results. This tubing is readily available, and has consistent elasticity characteristics. For example, a tubing having a relaxed length of approximately twelve inches between a pair of snap hooks 18, such as are used to connect the foot stirrup members to the waist members, exerts a constant pull as it is used.

The foregoing description of the preferred embodiment of the invention should be considered as illustrative and not as limiting. For example, the particular snap hooks and the rings which are shown, easily may be replaced with rings of other shapes and snap hooks of other types, as desired. Also, while hook-and-loop fasteners have been described as the preferred fasteners for attaching the various parts of the device on the body of a person, clearly other types of fasteners, such as conventional belt buckles, snaps, double D rings, and the like, may be employed if desired. The particular materials mentioned also should be considered as illustrative; and other materials exhibiting comparable characteristics may be substituted. Various other changes and modifications will occur to those skilled in the art for accomplishing the same result, and using substantially the same structure in substantially the same way, without departing from the true scope of the invention as defined in the appended claims.

I claim:

1. A body exercise kit including in combination:

a waist encircling member with a plurality of connector devices attached thereto and spaced at intervals along the length thereof;

a releasable fastener for securing said waist encircling member about the waist of a user, first and second foot pieces for releasable attachment to the foot of a user and each having a first portion for encircling the foot and a second portion for encircling the ankle of a user;

at least a first hand piece for grasping by the hand of a user;

first and second elastic members each having first and second ends, with the first ends thereof for connection with said first and second foot pieces, respectively, and the second ends thereof for releasable connection with selected ones of the connector devices on said waist encircling member;

a third elastic member having first and second ends, with the first end thereof for connection with said hand piece and the second end thereof for releasable connection with a selected one of the connector devices on said waist encircling member; and a fourth elastic member having first and second ends for releasable connection, respectively, with said second portions of said first and second foot pieces.

2. The combination according to claim 1 wherein said hand piece further includes a connector device thereon for releasable connection with the first end of said second elastic member; and a wrist protection flap attached to said hand piece and underlying said connector device on said hand piece when said hand piece is grasped by the hand of a user.

3. The combination according to claim 2 wherein said connector devices on said waist encircling member comprise snap rings and further including snap hooks attached to the second ends of each of said first, second and third elastic members for connection with selected ones of said snap rings on said waist encircling member.

4. The combination according to claim 3 wherein said first and second elastic members are made of stretchable tubing.

5. The combination according to claim 4 wherein said stretchable tubing comprises hollow surgical tubing.

6. The combination according to claim 5 wherein said hand piece comprises an elongated flexible rectangular strip of material having first and second ends with a releasable fastener thereon for encircling the hand of a user.

7. The combination according to claim 6 wherein the releasable fastener on said hand piece comprises mating hook and loop fastener material on said first and second ends, respectively, of said elongated rectangular strip of material.

8. The combination according to claim 1 wherein said connector devices on said waist encircling member comprise snap rings which are pivotally secured to said waist encircling member; and further including snap rings which are pivotally connected to said hand piece and said first and second foot pieces for releasable connection with the first ends of said third, first and second elastic members, respectively.

9. The combination according to claim 8 wherein said elastic members are made of stretchable tubing.

10. The combination according to claim 9 wherein said stretchable tubing comprises hollow surgical tubing.

11. The combination according to claim 1 wherein said connector devices on said waist encircling member comprise snap rings and further including snap hooks attached to the second ends of each of said first, second and third elastic members for connection with selected ones of said snap rings on said waist encircling member.

12. The combination according to claim 1 wherein said hand piece comprises an elongated flexible rectangular strip of material having first and second ends with a releasable fastener thereon for encircling the hand of a user.

13. The combination according to claim 1 wherein said first and second foot pieces further include a first connector device located on one side of the ankle encircling portion and a second connector device located on an opposite side of the ankle encircling portion thereof.

14. The combination according to claim 1 wherein said hand piece further includes a connector device thereon for releasable connection with the first end of said third elastic member; and a wrist protection flap attached to said hand piece and underlying said connector device on said hand piece when said hand piece is grasped by the hand of a user.

15. The combination according to claim 14 wherein said connector devices on said first and second foot pieces and on said hand piece comprise snap rings and wherein the first ends of said first, second and third elastic members further include a snap hook attached thereto for engagement with the snap rings on said first and second foot pieces and said hand piece, respectively.

* * * * *